US005509143A

United States Patent [19]

Yates et al.

[11] Patent Number: 5,509,143

[45] Date of Patent: Apr. 23, 1996

[54] THERMAL GLOVE WITH POCKET FOR FINGER HEATER

[76] Inventors: James W. Yates, Rte. 1, Box 585; Ronnie L. Yates, Box 3441, both of Wise, Va. 24293

[21] Appl. No.: 369,112

[22] Filed: Jan. 5, 1995

[51] Int. Cl.[6] ..... A41D 19/00

[52] U.S. Cl. ..... 2/160; 2/158

[58] Field of Search ..... 2/158, 159, 160, 2/161.1, 161.5, 161.6, 162

[56] References Cited

U.S. PATENT DOCUMENTS

| | | | |
|---|---|---|---|
| 1,970,081 | 8/1943 | Eisendrath | 2/158 |
| 2,274,335 | 2/1942 | Kennedy | 2/158 |
| 2,315,889 | 4/1943 | Wells | 2/158 |
| 2,323,136 | 6/1943 | Johanson | 2/158 |
| 2,451,837 | 10/1948 | La Londe et al. | 2/158 |
| 3,403,408 | 10/1968 | Helfer | 2/158 |
| 4,543,671 | 10/1985 | Monk | 2/158 |
| 4,587,672 | 5/1986 | Madnick et al. | 2/158 |
| 4,651,350 | 3/1987 | Dawiedczyk . | |
| 4,933,992 | 6/1990 | Kallman | 2/158 |
| 5,230,333 | 7/1993 | Yates et al. | 2/239 |

*Primary Examiner*—C. D. Crowder
*Assistant Examiner*—Larry D. Worrell, Jr.
*Attorney, Agent, or Firm*—Laubscher & Laubscher

[57] ABSTRACT

A heated glove includes a cap portion that is pivotally connected by stitching with a hand portion to cover and uncover the user's fingers which project from one end of the hand portion, the cap portion containing a pocket for receiving a pervious pouch containing an oxygen-activated heating chemical. The stitching arrangement is such that the user may simply manipulate the fingers of a single hand to pivot the cap portion associated therewith rearwardly to the finger-uncovered inoperative position.

9 Claims, 3 Drawing Sheets

FIG. 1
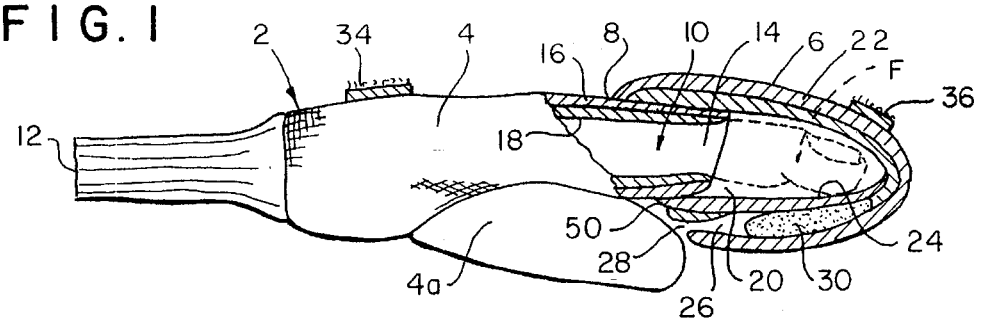
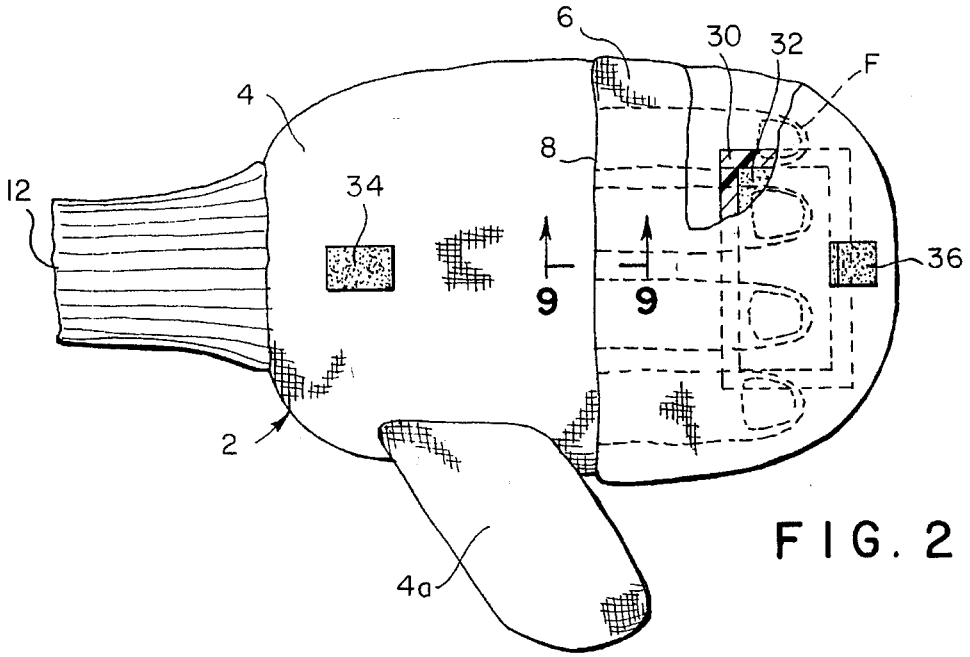
FIG. 2
FIG. 3
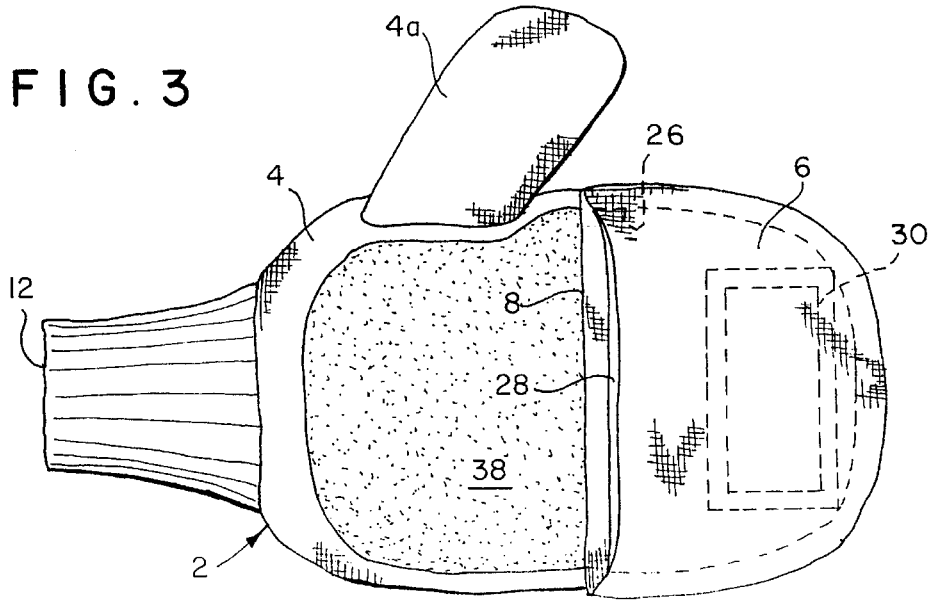

FIG. 4
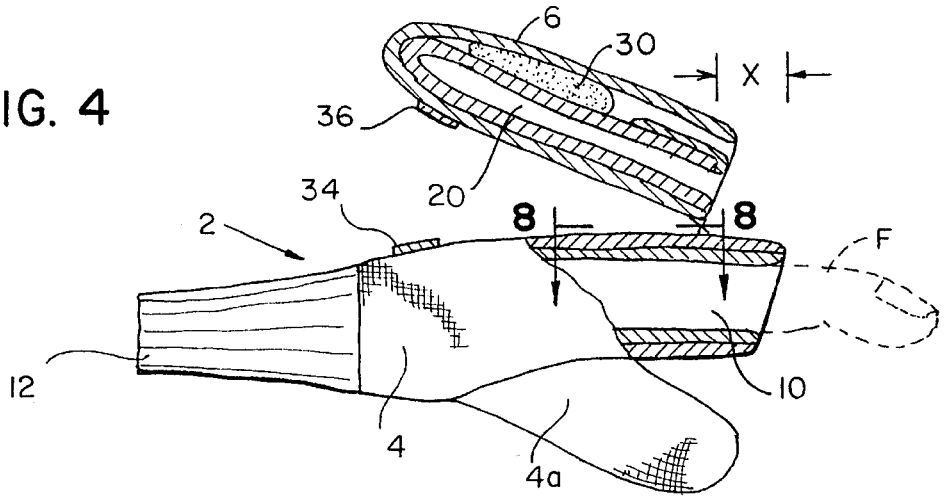
FIG. 5
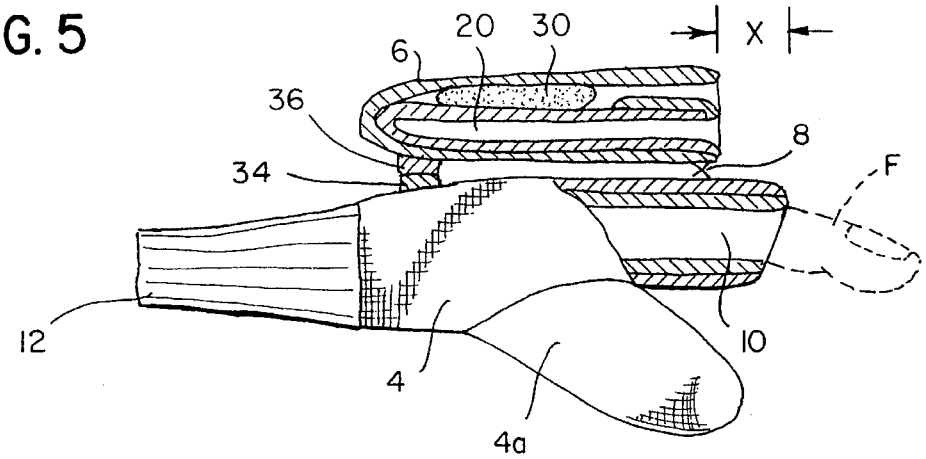
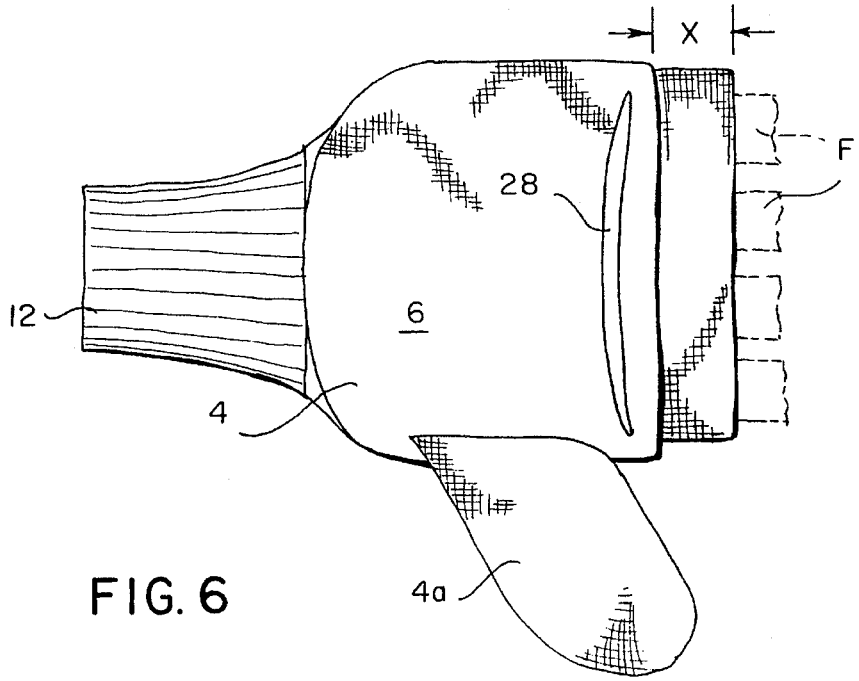
FIG. 6

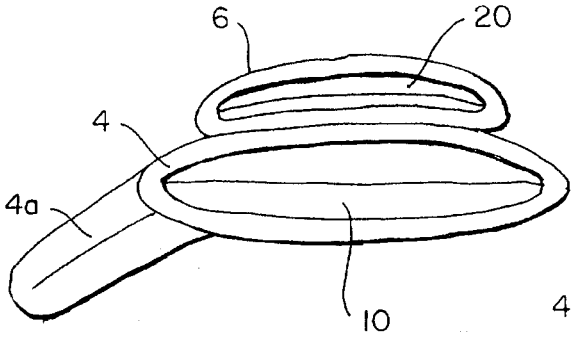
FIG. 7
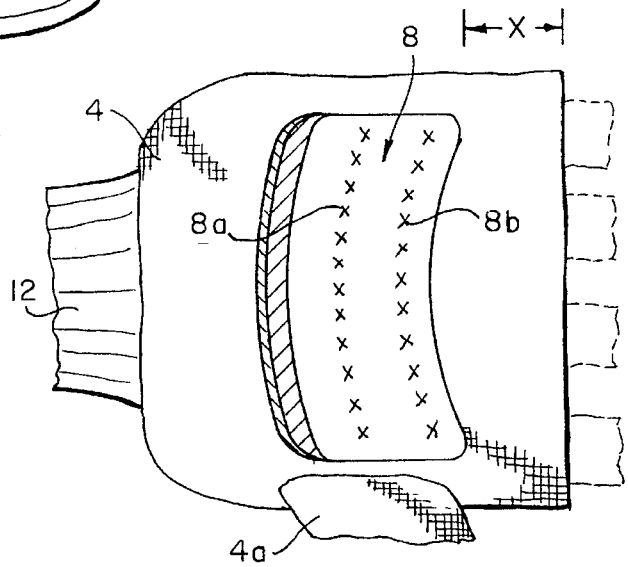
FIG. 8
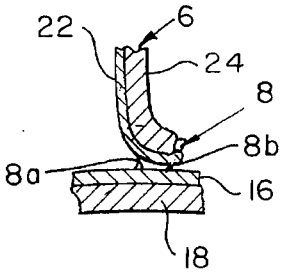
FIG. 9
FIG. 10
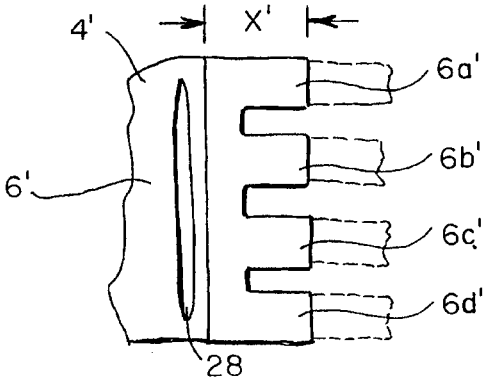

THERMAL GLOVE WITH POCKET FOR FINGER HEATER

A heated glove includes a cap portion having a pocket for receiving a pervious oxygen-activated chemical heating pouch, and a glove hand portion to which the cap portion is stitched for pivotal movement between finger-covering operative and finger-uncovering inoperative positions, respectively.

BRIEF DESCRIPTION OF THE PRIOR ART

It is known in the prior art to provide pockets on articles of clothing for receiving a chemical-type heating pouch, as evidenced by applicant's prior U.S. Pat. No. 5,230,333, and the patents to Madnick No. 4,587,672, Monk No. 4,543,671 and Eisendrath No. 1,970,081.

As shown by the Dawiedczyk patent No. 4,651,350, it is also known in the glove art to provide a glove having a hand portion and a cap portion pivotally connected for movement relative to the hand portion to cover and uncover the tips of the user's fingers that extend outwardly from the glove hand portion. One problem occurring in the use of such gloves is that two hands are generally required to cover and uncover the user's fingers.

The present invention was developed to provide an improved heated glove construction that more positively warms the user's hands, and in which the cap portion of a given glove may be pivoted from the operative finger-covering position to the inoperative finger uncovering position merely by manipulation of the user's fingers of the single hand associated with the glove.

SUMMARY OF THE INVENTION

Accordingly, a primary object of the present invention is to provide a heated glove in which a cap portion containing a pocket for receiving a chemical-type heating pouch is pivotally connected by stitching means with a body portion for pivotal movement between a finger-covering operative position and a finger-uncovering inoperative position.

In accordance with a more specific object of the invention, the stitching means is such that the cap portion may be flipped back from the operative position to the inoperative position merely by the appropriate manipulation of the user's fingers on the single hand associated with that glove.

BRIEF DESCRIPTION OF THE DRAWINGS

Other objects and advantages of the invention will become apparent from a study of the following specification, when viewed in the light of the accompanying specification, in which:

FIG. 1 is a partially sectioned side elevational view of the heated glove of the present invention;

FIGS. 2 and 3 are top and bottom views, respectively, of the heated glove of FIG. 1;

FIGS. 4 and 5 are partially sectioned views indicating the cap portion of the glove in intermediate and final inoperative positions, respectively;

FIG. 6 is a top plan view of the heated glove when in the inoperative position of FIG. 5, and FIG. 7 is a right-hand end view of the glove of FIG. 6;

FIG. 8 is a detailed sectional view taken along line 8—8 of FIG. 4;

FIG. 9 is a detailed sectional view taken along line 9—9 of FIG. 2; and FIG. 10 is a detailed view of a second embodiment of the invention.

DETAILED DESCRIPTION

Referring first more particularly to FIGS. 1–3, the heated glove 2 of the present invention includes a hand portion 4 to which a cap portion 6 is pivotally connected by stitching means 8. The hand portion 4 contains a central chamber 10 into which the user's hand is inserted via an elastic first opening 12 at one end of the hand portion, and at its other end the hand portion contains a second opening 14 through which the fingers F of the user project. The hand portion includes an outer layer 16 formed of a durable fabric such as POLARTOUGH, and an inner layer 18 formed of a suitable insulating material such as THINSULATE. The hand portion 4 also includes a thumb-receiving appendage 4*a*.

The cap portion 6 is hollow and contains an inner chamber 20 that receives the user's fingers F when the cap member is in the operable hand-heating position of FIG. 1. The cap portion 6 includes outer and inner layers 22 and 24 that correspond with the layers 16 and 18 of the hand portion. As shown in FIG. 1, the palm side of the cap portion 6 contains a pocket 26 for receiving via opening 28 a pouch 30 containing an oxygen-activated heating chemical 32, similar to the MEDIHEAT product produced by Heatmax, Inc. of Dalton, Ga. The rear surfaces of the hand and cap portions are provided with mating Velcro fastener components 34 and 36 for maintaining cap portion 6 in the inoperative retracted position of FIG. 5, as will be described below. The palm side of the glove is provided with a washable leather protective layer 38, as shown in FIG. 3.

According to a characterizing feature of the present invention, the stitching means 8 for connecting the cap portion 6 with the hand portion 4 extends generally orthogonally relative to the longitudinal axis of the hand portion and is spaced rearwardly from the second end of the hand portion 4 by a given distance x, as shown in FIGS. 4–6. As best shown in FIG. 8, the stitching means 8 includes a pair of parallel stitch lines 8*a* and 8*b* that have a convex stitching pattern relative to the first end 12 of the glove hand portion. Thus, when the cap portion 6 is in the operative position of FIG. 1 and the user inserts his fingers in the gap 50 between the free end of the cap member 6 and the adjacent palm portion of the glove hand portion 4, the user merely flexes his fingers to initiate rearward pivotal movement of the cap portion 6, whereupon the convex configuration of the stitching 8 and the momentum caused by the flicking of the fingers pivots the cap member successively toward the intermediate and final inoperative positions of FIGS. 4 and 5, respectively. During this rearward pivotal movement of the cap portion 6, the weight of the heating pouch 30 adds momentum for enhancing the rearward pivotal movement of the cap portion. When the cap portion 6 reaches the final inoperative position of FIG. 5, the Velcro fastener components 34 and 36 engage to retain the cap portion 6 in its inoperative position.

It should be noted in FIG. 1 that when the cap portion 6 is in the operative hand-warming position, the entire circumferential second edge portion of the glove hand portion 4 extends completely within the chamber 20 contained within the cap portion 6.

In operation, a user inserts the heating pouch 20 within the pocket 26 via pocket opening 28, and inserts his hand into the internal chamber 10 of the hand portion 4 via the elastic first end portion containing the hand opening 12. The fingers of the user then project from the free end of the hand portion 4, and the cap portion is pivoted forwardly about the stitching pivot axis 8 to the operable finger-covering position of FIG. 1. The heating pouch continues to warm the fingers of the user during use, such as the gripping of ski poles during skiing, for example.

Assume now that the user wishes to remove the cap portion 6 in order to shoot a gun, for example. The user merely inserts his fingers into the gap 50 between the cap portion 6 and the palm surface of the hand portion 16, and owing to the distortion of the part of the hand portion defined by the distance x, together with the convex configuration of the stitches, the cap portion 6 is pivoted rearwardly to the position shown in FIG. 4. The mass of the heating pouch 30 assists the stitch means in causing rearward pivotal movement of the cap portion 6 to the inoperative position of FIG. 5, whereupon the Velcro fasteners 34 and 36 engage to retain the cap portion in the FIG. 5 condition. Thus, the rearward pivotal movement of the cap portion of the glove can be accomplished independently by the single associated hand of the user, and consequently two hands are not required to remove the cap portion from the hand portion.

In the embodiment of the FIGS. 1–9, the hand portion 50 has a single opening 14 at its second end, and consequently in a muff-like manner the user may intertwine the fingers from each hand into the chambers of the hand portions of the glove when the cap portions are in the retracted inoperative positions, respectively.

Referring to FIG. 10, the invention is also applicable to a glove in which instead of one single opening, the glove contains a plurality of finger portions *6a–6b* for receiving the user's fingers, respectfully.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. A heated glove for use by hunters and outdoorsmen, comprising:

(a) a hollow hand portion formed of flexible fabric material and having an opening at a first end for receiving a user's hand, said hand portion containing at least one second opening at its other end through which the user's fingers outwardly project, said hand portion having oppositely facing palm and rear sides;

(b) a hollow cap portion formed of flexible fabric material and containing a chamber having an opening at one end, said cap portion having oppositely facing palm and rear sides;

(c) stitching means connecting said cap portion with the rear surface of said hand portion for alternate pivotal movement through an angle of about 180° between an operative position in which the user's fingers extend through said cap opening into said cap chamber via said cap opening, and an inoperative position in which the cap portion is removed from the user's fingers and the rear side of said cap portion is seated on said hand portion rear side, said stitching means extending generally orthogonally relative to the longitudinal axis of said hand portion, said stitching means being spaced a given distance (x) from said hand portion one end and having such a configuration as to bias said cap portion toward said inoperative position upon manipulation of the associated fingers of the user; and (d) means defining in one of said cap portion palm and rear sides a pocket for receiving an oxygen-activated chemical heating packet.

2. A heated glove as defined in claim 1, wherein said pocket is formed in the palm side of said cap portion.

3. A heated glove as defined in claim 2, wherein said cap opening is adjacent said hand portion second end when said cap portion is in the inoperative position.

4. A heated glove as defined in claim 1, and further including Velcro means for retaining said cap portion in the inoperative position relative to said hand portion.

5. A heated glove as defined in claim 1, wherein said hand position has a single second opening through which all of the user's fingers project.

6. A heated glove as defined in claim 1, wherein said hand portion has a plurality of finger openings through which the user's fingers respectively project.

7. A heated glove as defined in claim 1, wherein said hand portion contains a thumb-receiving hollow appendage.

8. A heated glove as defined in claim 1, wherein said second end of said hand portion extends within said cap chamber when said cap is in said operative position.

9. A heated glove as defined in claim 1, wherein said stitching means has a generally convex pattern relative to said hand portion first end.

* * * * *